US010190338B2

(12) United States Patent
Matyko

(10) Patent No.: US 10,190,338 B2
(45) Date of Patent: Jan. 29, 2019

(54) ELECTROMECHANICAL LOCK ASSEMBLY

(71) Applicant: MUL-T-LOCK TECHNOLOGIES LTD., Yavne (IL)

(72) Inventor: Adalbert Matyko, Ashdod (IL)

(73) Assignee: Mul-T-Lock Technologies Ltd., Yavne (IL)

( * ) Notice: Subject to any disclaimer, the term of this patent is extended or adjusted under 35 U.S.C. 154(b) by 139 days.

(21) Appl. No.: 15/308,679

(22) PCT Filed: Apr. 29, 2015

(86) PCT No.: PCT/IB2015/053103
§ 371 (c)(1),
(2) Date: Nov. 3, 2016

(87) PCT Pub. No.: WO2015/170224
PCT Pub. Date: Nov. 12, 2015

(65) Prior Publication Data

US 2017/0204637 A1 Jul. 20, 2017

(30) Foreign Application Priority Data

May 7, 2014 (IL) ..... 232498

(51) Int. Cl.
*E05B 67/36* (2006.01)
*E05B 67/22* (2006.01)
(Continued)

(52) U.S. Cl.
CPC ..... *E05B 67/36* (2013.01); *E05B 47/0001* (2013.01); *E05B 47/06* (2013.01);
(Continued)

(58) Field of Classification Search
CPC ..... E05B 67/36; E05B 65/48; E05B 47/0001; E05B 47/06; E05B 2047/0058; E05B 2047/0094
(Continued)

(56) References Cited

U.S. PATENT DOCUMENTS 6,761,051 B1 * 7/2004 Tsai ..... E05B 47/0012 70/257
6,993,943 B1 * 2/2006 Chang ..... E05B 47/0012 70/277
(Continued)

FOREIGN PATENT DOCUMENTS

| | | |
|---|---|---|
| WO | 2004/072418 | 8/2004 |
| WO | 2012/102633 | 8/2012 |
| WO | 2014/032426 | 3/2014 |

OTHER PUBLICATIONS

PCT Search and Written Opinion PCT/IB2015/053103, dated Nov. 17, 2015.

*Primary Examiner* — Suzanne L Barrett
(74) *Attorney, Agent, or Firm* — Dekel Patent Ltd.; David Klein

(57) ABSTRACT

A lock assembly (10) includes a first member (12) and a second member (14) including complimentary shaped protrusions (13) and recesses (15) that mate with one another. A locking assembly is housed in the first member (12). The locking assembly includes an electromechanical actuator (18) with a shaft (20) and a locking element (22) arranged to move along the shaft (20) between a locked position and an unlocked position. The locking element (22) is formed with a recess. In the locked position, a locking bolt (16) passes through both first and second first member (12)s and a latch member (26) is received in the notch (28) but is not received in the recess of the locking element (22) so that the locking element (22) prevents movement of the latch mem-
(Continued)

ber (26) and the locking bolt (16). In the unlocked position, the latch member (26) is received in the recess of the locking element (22), thereby permitting movement of the locking bolt (16).

7 Claims, 5 Drawing Sheets

(51) Int. Cl.

| | |
|---|---|
| ***E05B 47/00*** | (2006.01) |
| ***E05B 47/06*** | (2006.01) |
| ***E05B 65/48*** | (2006.01) |
| ***E05B 67/02*** | (2006.01) |

(52) U.S. Cl.
CPC ..... *E05B 65/48* (2013.01); *E05B 67/02* (2013.01); *E05B 67/22* (2013.01); *E05B 2047/0058* (2013.01); *E05B 2047/0094* (2013.01)

(58) Field of Classification Search
USPC ..... 70/20–58, 275–277, 278.1, 278.3
See application file for complete search history.

(56) References Cited

U.S. PATENT DOCUMENTS

| | | | | |
|---|---|---|---|---|
| 7,076,976 | B1 * | 7/2006 | Goldman | E05B 17/2084 70/233 |
| 7,946,142 | B2 | 5/2011 | Matyko | |
| 2013/0118216 | A1 * | 5/2013 | Kalous | G07C 9/00944 70/24 |

* cited by examiner

ELECTROMECHANICAL LOCK ASSEMBLY

CROSS-REFERENCE TO RELATED APPLICATIONS

This application is a national phase application of PCT patent application PCT/IB2015/053103, filed 29 Apr. 2015, which claims priority to Israel Patent Application 232498, filed 7 May 2014, which are incorporated herein by reference.

FIELD OF THE INVENTION

The present invention relates generally to high security locks and particularly to an electromechanical lock assembly.

BACKGROUND OF THE INVENTION

Padlocks that have protected hasps are known in the art and are referred herein as hasp locks. In a typical installation of a hasp lock, each side of a door opening (e.g., a hinged door and a jamb, or two sliding doors) is provided with a protective hasp for a lock body and shackle of a lock. Thus there are two hasp bodies which mate together when the doors are closed, and a shackle or locking pin locks the hasp bodies together.

For example, U.S. Pat. No. 7,946,142 to Matyko et al. describes a hasp lock, which includes a first member and a second member. The two members include complimentary shaped protrusions and recesses that mate with one another. A locking assembly is housed in the first member, including a cylinder lock that brings a locking element into locking engagement with a notch formed in a locking bolt. The locking bolt is arranged for sliding motion through a first bore formed in the first member. When the second member is aligned with the first member, the locking bolt is slidable into a second bore formed in the second member so as to lock the first and second members together. The locking element is movable into locking engagement with a second notch formed in the locking bolt so as to prevent moving the locking bolt completely out of the first member.

SUMMARY OF THE INVENTION

The present invention seeks to provide an improved electromechanical lock assembly, as described more in detail hereinbelow.

It is noted that the term "door" as used throughout the specification and claims encompasses any kind of door, window, gate or panel, for example.

There is thus provided in accordance with an embodiment of the present invention a lock assembly including a first member and a second member including complimentary shaped protrusions and recesses that mate with one another, and a locking assembly housed in the first member, the locking assembly including an electromechanical actuator with a shaft and a locking element arranged to move along the shaft between a locked position and an unlocked position, the locking element being formed with a recess, a latch member, and a locking bolt formed with a notch, wherein in the locked position, the locking bolt passes through both first and second first members and the latch member is received in the notch but is not received in the recess of the locking element so that the locking element prevents movement of the latch member and the locking bolt, and in the unlocked position, the latch member is received in the recess of the locking element, thereby permitting movement of the locking bolt.

In accordance with an embodiment of the present invention the shaft is threaded and rotatable by the actuator, and the locking element is complimentarily threaded such that rotation of the shaft causes the locking element to move linearly along the shaft.

In accordance with an embodiment of the present invention a battery powers the actuator. A battery retaining member is provided with a battery locking member engageable with the battery retaining member. In the locked position, the locking bolt locks the battery locking member and prevents movement of the battery retaining member. In the unlocked position, the locking bolt permits movement of the battery locking member and the battery retaining member to gain access to the battery.

In accordance with an embodiment of the present invention the battery locking member includes a spring-loaded pin engageable with the battery retaining member.

In accordance with an embodiment of the present invention a transceiver is in communication with the actuator for actuating the actuator.

BRIEF DESCRIPTION OF THE DRAWINGS

The present invention will be understood and appreciated more fully from the following detailed description taken in conjunction with the drawings in which.

DETAILED DESCRIPTION OF EMBODIMENTS

Reference is now made to FIGS. 1-4, which illustrate a lock assembly 10, constructed and operative in accordance with a non-limiting embodiment of the present invention. Lock assembly 10 is described for a hasp lock but the invention is not limited to hasp locks.

Figure 1:
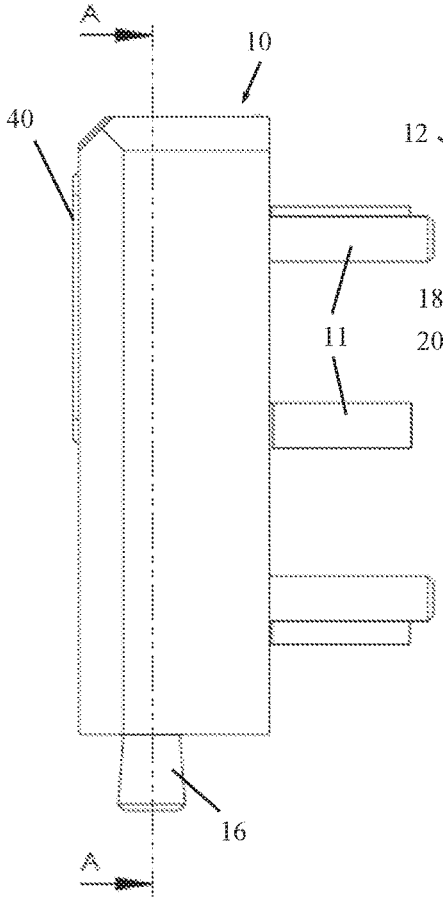
FIGS. 1 and 2 are simplified side-view and sectional illustrations of a lock assembly, constructed and operative in accordance with an embodiment of the present invention, with FIG. 2 being taken along lines A-A in FIG. 1 and showing a locking element in a locked position which prevents moving a locking bolt.
Figure 4:
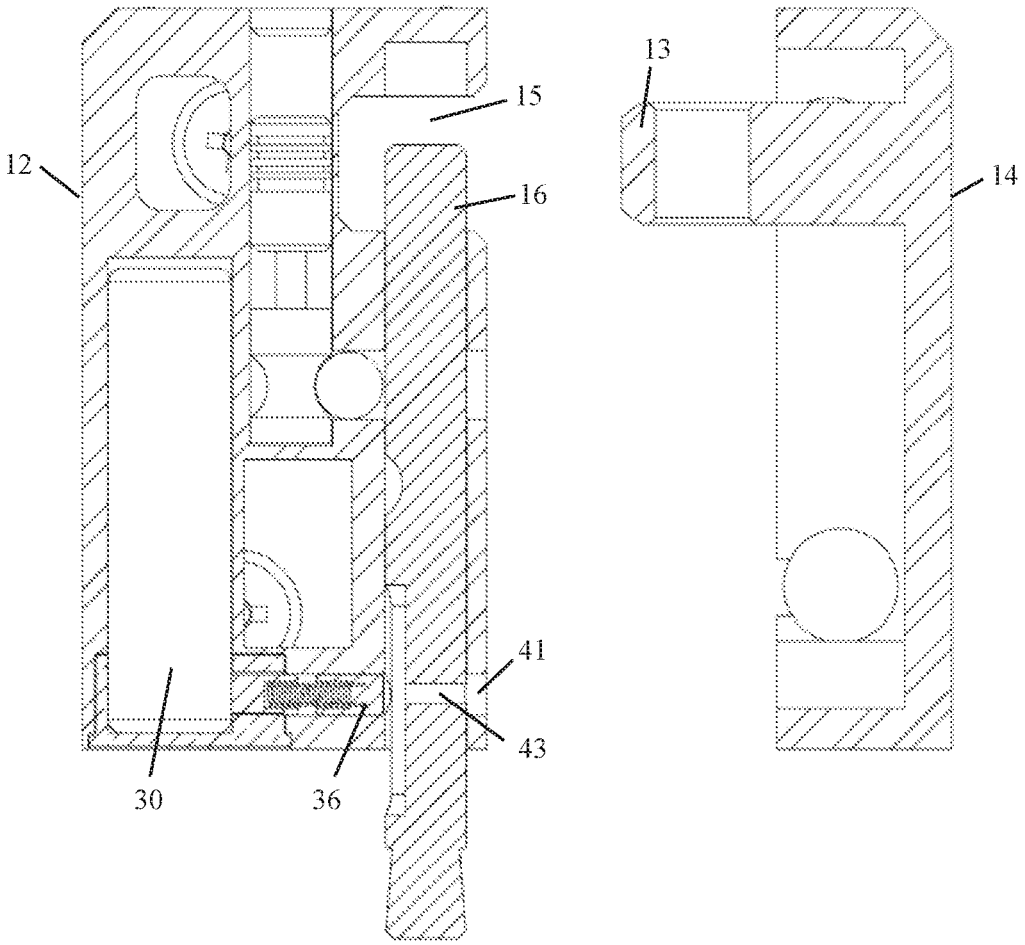
FIG. 4 is a simplified sectional illustration of the lock assembly, showing separation of the two halves of the lock assembly after unlocking the assembly.

Hasp lock assembly 10 includes a first member 12 and a second member 14. The first member 12 may house a locking assembly that includes a locking bolt 16 that may pass through a portion of second member 14 so as to lock the two members together. The members 12 and 14 and locking bolt 16 may be constructed of any suitable material, such as but not limited to, hardened steel alloy. The first and second members 12 and 14 include one or more complimentary shaped protrusions 13 and recesses 15 that mate with one another (FIG. 4). The first and second members 12 and 14 also include one or more mechanical fasteners 11 (FIG. 1)

that protrude out the back of the case of the assembly for fastening the assembly to a door.

Figure 6:
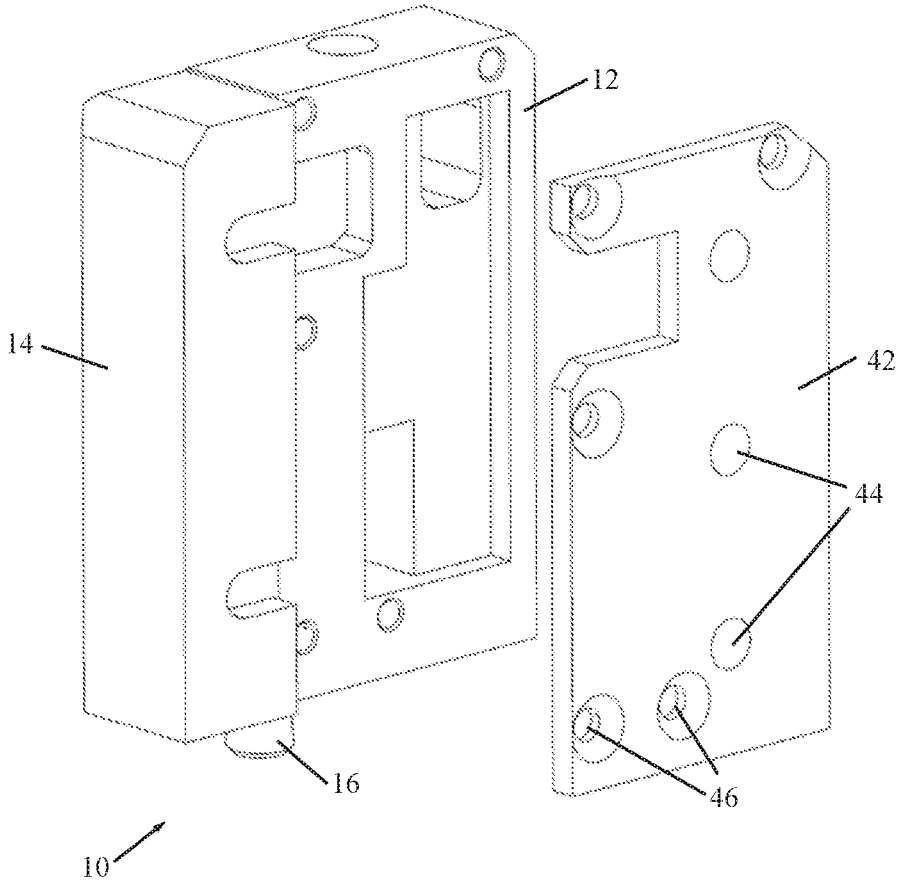
FIG. 6 is a simplified rear-view illustration of the lock assembly, showing a back plate which has different mounting provisions.

FIG. 6 illustrates an optional back plate 42 of hasp lock assembly 10, which has different mounting provisions 44 for accommodating the mechanical fasteners (not shown in FIG. 6), and which has different mounting holes 46 for attaching the back plate 42 to the assembly 10.

The locking assembly includes an electromechanical actuator 18, such as but not limited to, a servomotor, solenoid, gear motor, electromagnet and the like. Actuator 18 has a shaft 20, and a locking element 22 formed with a recess 24 is arranged to move along shaft 20 between a locked position and an unlocked position, as will be explained further below. Locking element 22 cooperates with a latch member 26, such as but not limited to, a locking ball. Shaft 20 may be threaded and rotatable by actuator 18, in which case locking element 22 may be complimentarily threaded such that rotation of shaft 20 causes locking element 22 to move linearly along shaft 20.

Figure 2:
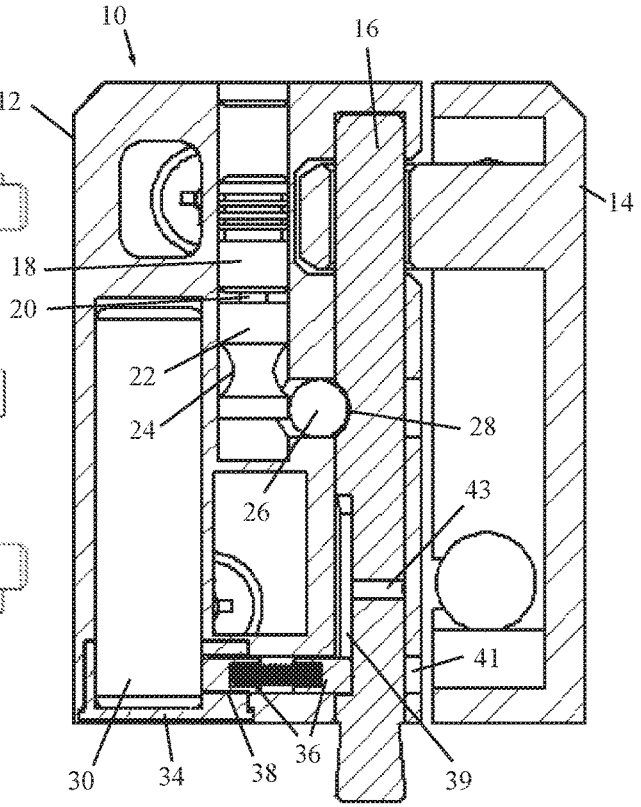
Figure 3:
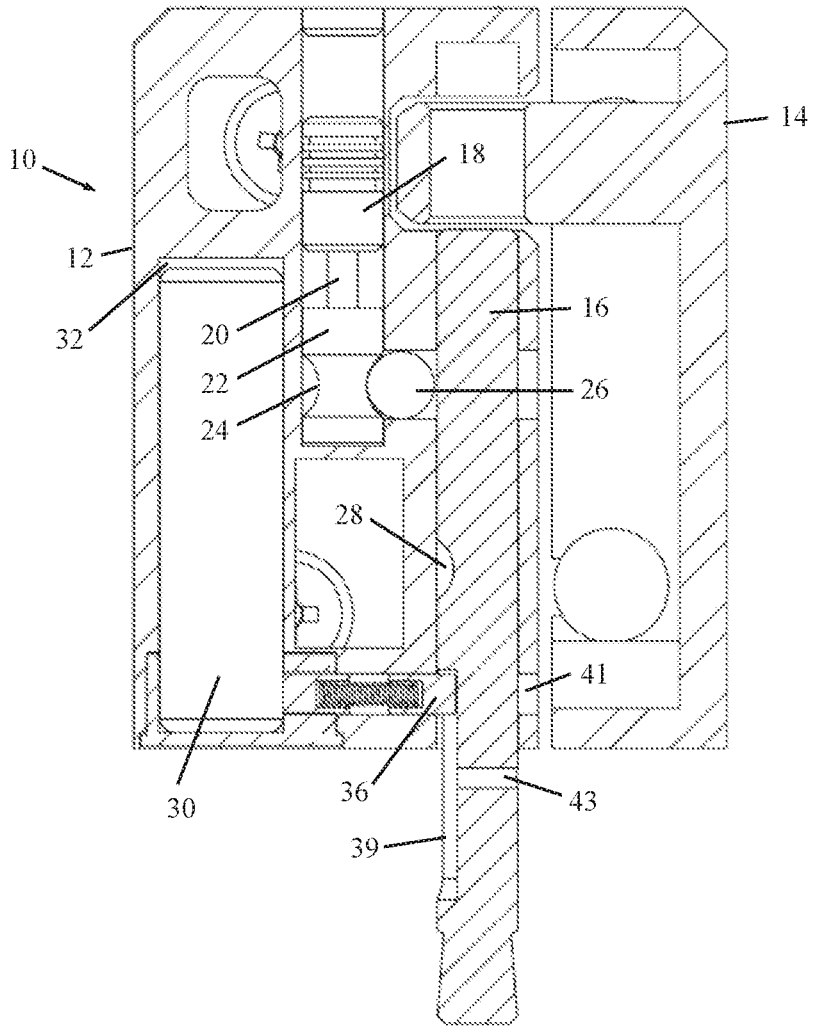
FIG. 3 is a simplified sectional illustration of the lock assembly of FIG. 2 with the locking element in an unlocked position which allows moving a locking bolt to open the lock assembly.

In the locked position shown in FIG. 2, locking bolt 16 passes through both first and second first members 12 and 14 and latch member 26 is received in a notch 28 formed in locking bolt 16. However, latch member is not received in recess 24 of locking element 22. In this manner, locking element 22 prevents movement of latch member 26 (the ball is sandwiched between locking element 22 and locking bolt 16 and cannot budge) and locking bolt 16. FIG. 3 shows the unlocked position, in which actuator 18 has caused locking element 22 to move linearly along shaft 20 (downward in the sense of the drawing). In this position, latch member 26 is free to move and be received in recess 24 of locking element 22, thereby permitting movement of locking bolt 16 (downward in the sense of the drawing). FIG. 4 illustrates separation of first and second first members 12 and 14 after unlocking the assembly (for example, to permit opening a door to which the assembly is fastened).

Figure 5:
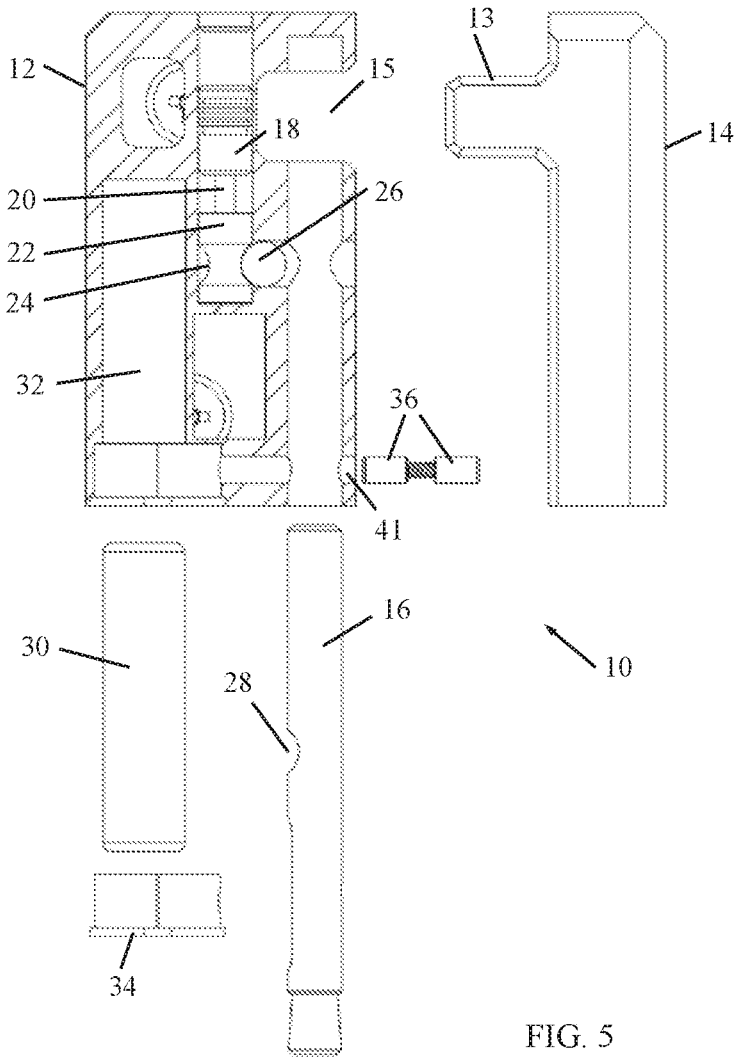
FIG. 5 is a simplified partial sectional illustration of the lock assembly, showing removal of the locking bolt to allow removal of the battery.

In accordance with an embodiment of the present invention a battery 30 powers actuator 18 and the locking bolt 16 must be removed in order to gain access to battery 30, as is now explained with reference to FIGS. 4 and 5. This feature provides security to prevent unauthorized persons from tampering with or stealing the battery.

Battery 30 is retained inside a compartment 32 formed in first member 12. A battery retaining member 34 closes compartment 32, and is engageable with a battery locking member 36. Battery locking member 36 may include a spring-loaded pin engageable with battery retaining member 34. Specifically, in the illustrated embodiment, the spring-loaded pin enters a hole 38 (FIG. 2) formed in battery retaining member 34 and abuts against the battery 30. In the locked position, locking bolt 16 locks battery locking member 36 and prevents movement of battery retaining member 34. Battery locking member 36 cannot move because it is sandwiched between battery retaining member 34 and a channel 39 (FIG. 2) formed in locking bolt 16. Channel 39 serves as a stop when unlocking the assembly; that is, locking bolt 16 will not drop completely out of the assembly but instead will be retained in the unlocked assembly as seen in FIG. 3 because the battery locking member 36 abuts against the end of channel 39.

It is noted that first member 12 and locking bolt 16 are formed with a hasp aperture (through hole) 41 and a bolt aperture 43, respectively. In order to gain access to battery 30 after unlocking the locking bolt 16, instead of moving locking bolt 16 to the end of its travel as in FIG. 3, locking bolt 16 is moved so that bolt aperture 43 is aligned with hasp aperture 41, as in FIG. 4. A small tool, such as a pin (not shown), can be inserted through apertures 41 and 43 to push against the spring-loaded pin of battery locking member 36. As seen in FIG. 5, this permits removal of locking bolt 16 out of the assembly so as to permit removal of battery locking member 36 and of battery retaining member 34 to gain access to battery 30.

In accordance with an embodiment of the present invention a transceiver 40 (FIG. 1) is in communication with actuator 18 for actuating actuator 18. Transceiver 40 may be any suitable transponder that works with wireless communication, such as but not limited to, infrared, BLUETOOTH, RF, cellular telephone communication, internet communication and so forth. In this manner, the hasp lock assembly 10 can be opened by remote communication, such as from a command center. A mechanical override may be provided, if desired.

What is claimed is:

1. A lock assembly comprising:

a first member and a second member comprising one or more complimentary shaped protrusions and recesses that mate with one another; and a locking assembly housed in said first member, said locking assembly comprising an electromechanical actuator with a shaft and a locking element arranged to move along said shaft between a locked position and an unlocked position, said locking element being formed with a recess;

a latch member; and a locking bolt formed with a notch, wherein in the locked position, said locking bolt passes through both said first and second first members (12, 14) and said latch member is received in said notch but is not received in the recess of the locking element so that said locking element prevents movement of said latch member and said locking bolt, and in the unlocked position, said latch member is received in said recess of the locking element, thereby permitting movement of said locking bolt, and wherein said first member and said locking bolt are formed with a hasp through-hole and a bolt through-hole, respectively.

2. The lock assembly according to claim 1, wherein said shaft is threaded and rotatable by said actuator, and said locking element is complimentarily threaded such that rotation of said shaft causes said locking element to move linearly along said shaft.

3. The lock assembly according to claim 1, further comprising a battery to power said actuator.

4. The lock assembly according to claim 3, further comprising a battery retaining member and a battery locking member engageable with said battery retaining member, wherein in said locked position, said locking bolt locks said battery locking member and prevents movement of said battery retaining member, and in said unlocked position, said locking bolt permits movement of said battery locking member and said battery retaining member to gain access to said battery.

5. The lock assembly according to claim 4, wherein said battery locking member comprises a spring-loaded pin engageable with said battery retaining member.

6. The lock assembly according to claim 1, further comprising a transceiver in communication with said actuator for actuating said actuator.

7. The lock assembly according to claim 1, wherein said hasp through-hole is transverse to said locking bolt.

* * * * *